US006381335B2

(12) United States Patent
Juszkiewicz et al.

(10) Patent No.: US 6,381,335 B2
(45) **Date of Patent: *Apr. 30, 2002**

(54) AUDIO SPEAKER SYSTEM FOR PERSONAL COMPUTER

(75) Inventors: Henry E. Juszkiewicz, Nashville, TN (US); Andy J. Ewen, Chelmsford (GB)

(73) Assignee: Gibson Guitar Corp., Nashville, TN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/383,715

(22) Filed: Aug. 25, 1999

(51) Int. Cl.[7] ..... H04R 5/02; H04R 1/02

(52) U.S. Cl. ..... 381/306; 381/333; 381/388; 361/683

(58) Field of Search ..... 381/306, 333, 381/388, 300, 337–9, 345–8, 350, 351; 361/682–3; 248/917–8; 181/198, 199

(56) References Cited

U.S. PATENT DOCUMENTS

| | | | | | |
|---|---|---|---|---|---|
| 3,491,204 | A | * | 1/1970 | Sherno | 381/333 |
| 4,051,919 | A | * | 10/1977 | Buettner | 181/144 |
| 4,452,333 | A | * | 6/1984 | Peavey et al. | 181/144 |
| 5,027,403 | A | | 6/1991 | Short et al. | 381/27 |
| 5,222,145 | A | * | 6/1993 | Draffen | 381/90 |
| 5,533,129 | A | * | 7/1996 | Gefvert | 381/18 |
| 5,604,663 | A | * | 2/1997 | Shin et al. | 361/683 |
| 5,680,464 | A | | 10/1997 | Iwamatsu | 381/18 |
| 5,701,347 | A | * | 12/1997 | Daniels et al. | 361/683 |
| 5,729,430 | A | * | 3/1998 | Johnson | 361/682 |
| 5,764,777 | A | | 6/1998 | Goldfarb | 381/27 |
| 5,978,211 | A | | 11/1999 | Hong | 361/683 |

FOREIGN PATENT DOCUMENTS

| | | | | |
|---|---|---|---|---|
| WO | 93/14607 | * | 7/1993 | 181/144 |

OTHER PUBLICATIONS printout from the website of Bose regarding their Wave® radio/CD player (admitted to be prior art).

a printout of one page of a website for the DOLBY DigiTheatre Decoder by Videologic (admitted to be prior art).

one page copy of a magazine article describing the Videologic DigiTheatre of Exhibit B (admitted to be prior art).

three pages of printouts from the website of Minton.com regarding its AudioStorm Digital Decoder Box (admitted to be prior art).

(List continued on next page.)

*Primary Examiner*—Xu Mei
(74) *Attorney, Agent, or Firm*—Waddey & Patterson; Lucian Wayne Beavers

(57) ABSTRACT

A multi-channel audio speaker system is provided for use with a desktop personal computer. This system includes a cabinet having a bottom surface for placement upon a desktop and having a top surface for supporting a computer monitor. Left front, center front and right front speakers are housed in the cabinet along with two sub-woofer speakers. Left rear and right rear speakers are provided in separate remote cabinets. The primary cabinet includes an amplifier having seven channels of amplification. The system is provided for use with a multi-channel audio source such as Dolby® 5.1 format, which provides five channels of full range audio data which are directed to the first five channels of amplification and then to the front and rear speakers. The sixth channel of low frequency audio data is split and directed to the sixth and seventh amplification channels which are in turn directed to the two sub-woofer systems. A by-pass inlet signal conductor may also be provided so that the speaker system can be utilized with alternative sound sources such as a conventional high fidelity receiver.

28 Claims, 6 Drawing Sheets

OTHER PUBLICATIONS

Exhibit E is a brochure entitled Trace Elliot Amplification (undated, but admitted to be prior art) which discloses at the page numbered 8 models BLX 130SM and BLX80SM amplifiers.

Exhibit F is a brochure entitled Trace Elliot Base Amplification (undated, but admitted to be prior art) which discloses at page 7 the BLX80 amplifier.

Exhibit G is a brochure entitled Trace Elliot Base Amplification (undated, but admitted to be prior art) which discloses at the ninth page thereof, the BLX150HSM Combo and the BLX80SM Combo systems.

* cited by examiner

AUDIO SPEAKER SYSTEM FOR PERSONAL COMPUTER

BACKGROUND OF THE INVENTION

1. Field of the Invention

The present invention relates generally to high fidelity audio speaker systems, and more particularly, to such a system designed for use with a personal computer.

2. Description of the Prior Art

Over the years, various formats of multiple channel audio have been developed to provide ever increasing realism in sound reproduction.

The earliest systems were monophonic having only a single channel of sound. The next development was stereophonic sound having two channels.

Then various surround sound systems, such as quadraphonic systems having four channels were developed. One of the most recently developed multi-channel sound formats is that often referred to as Dolby® AC-3 or as Dolby® 5.1, which terms both refer to the same system. The Dolby® 5.1 system delivers six completely separate channels of sound. It includes left, center and right front channels for the front of the room. It includes left and right rear channels. It includes a sixth channel which has low frequency audio data.

The Dolby® 5.1 system was originally developed to provide high quality sound in movie theaters or the like. It has more recently become available in the home from several sources.

Digital video discs, commonly referred to as DVD's, now include a Dolby® 5.1 sound track.

Currently, probably 30 to 40 percent of the personal computers which are being sold include DVD players and provide a means for decoding the Dolby® 5.1 signal.

Another currently available source for the Dolby® 5.1 signal in the home environment is a Hi-Fi receiver for a home audio system. Most Hi-Fi receivers being sold today include a Dolby® 5.1 decoding circuit.

In spite of the fact that some of the personal computers presently being sold provide a Dolby® 5.1 sound source, there has not yet been available any suitable speaker system for use with a personal computer which can reproduce all six channels of sound information which are available from the Dolby® 5.1 format.

The typical audio system available for a personal computer simply includes a pair of stereo speakers which only effectively utilize two channels of data.

There is therefore, a need in the art for an audio speaker system capable of reproducing multi-channel sound and particularly sophisticated multichannel sound such as the Dolby® 5.1 format in connection with the home personal computer environment.

SUMMARY OF THE INVENTION

The present invention provides a multi-channel audio speaker system for use with a desktop personal computer. The system includes a cabinet having a bottom surface for placement upon a desk and having a top surface for supporting a computer monitor. At least first, second and third speakers are housed in the cabinet. Fourth and fifth speakers are located remote from the cabinet. An amplifier includes at least first, second, third, fourth and fifth channels of amplification connected to the first, second, third, fourth and fifth speakers, respectively. A primary inlet signal conductor carries at least five channels of audio data to the amplifier.

The system may also include one or more sub-woofer speakers contained in the cabinet and associated with a sixth channel of amplification which is included in the amplifier. The amplifier may include both a sixth and a seventh channel of amplification, each one of which is connected to one of the two sub-woofers if two sub-woofers are included in the system. In this system, the primary inlet signal conductor carries a sixth channel of low frequency audio data, which sixth channel is split and connected to each of the sixth and seventh amplifiers.

The system may also include a by-pass inlet signal conductor for by-passing the amplifier and carrying the first five channels of audio data direct to the first through fifth speakers. The sixth channel of audio data continues to be directed to the sixth channel of amplification. The by-pass inlet signal conductor is provided so that the system of the present invention may be utilized within an auxiliary Dolby® 5.1 sound source such as a conventional Hi-Fi receiver. Such a receiver conventionally only includes five channels of amplification, because most commonly used sub-woofer systems are self-amplified. Thus, the sixth channel of data from the Dolby® 5.1 system leaves the Hi-Fi receiver unamplified and must be amplified prior to being directed to the sub-woofer speakers.

The cabinet in which the speaker system is contained is particularly designed to be a relatively wide and shallow cabinet which conveniently fits on a conventional desktop and provides space for placement of a computer monitor on top of the cabinet. Thus, the cabinet will include the left front, center front and right front speakers along with the sub-woofer speakers, all of which will have outlets from the cabinet directed toward a person using the computer. The left and right rear speakers are remote speakers and will preferably be mounted on conventional microphone stands or the like placed in the room behind the user of the computer.

Thus, a very convenient, economical, effective and attractive system is provided for utilizing and reproducing all of the data available from a Dolby® 5.1 sound source, or other multi-channel source while using a personal computer. This system is particularly well suited for reproducing sound associated with computer games provided on a DVD player in the computer. Thus, the computer user, while playing the computer games can enjoy a state of the art sound experience associated with the playing of the computer game.

The system can, of course, also be utilized for reproducing sounds other than those associated with the computer games, such as music recordings and the like.

Accordingly, it is an object of the present invention to provide an improved audio sound system for use with a personal computer.

Another object of the present invention is the provision of an attractive and conveniently shaped cabinetry containing a sound system, which may be utilized to support a computer monitor on top of the cabinet.

Another object of the present invention is the provision of an audio sound system for use with a multi-channel audio source, of which the Dolby® 5.1 system is only an example.

Still another object of the present invention is the provision of a speaker system which may be alternatively utilized with a multi-channel sound source from a Hi-Fi audio receiver which already provides amplification for some or all of the channels of audio data.

Other objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
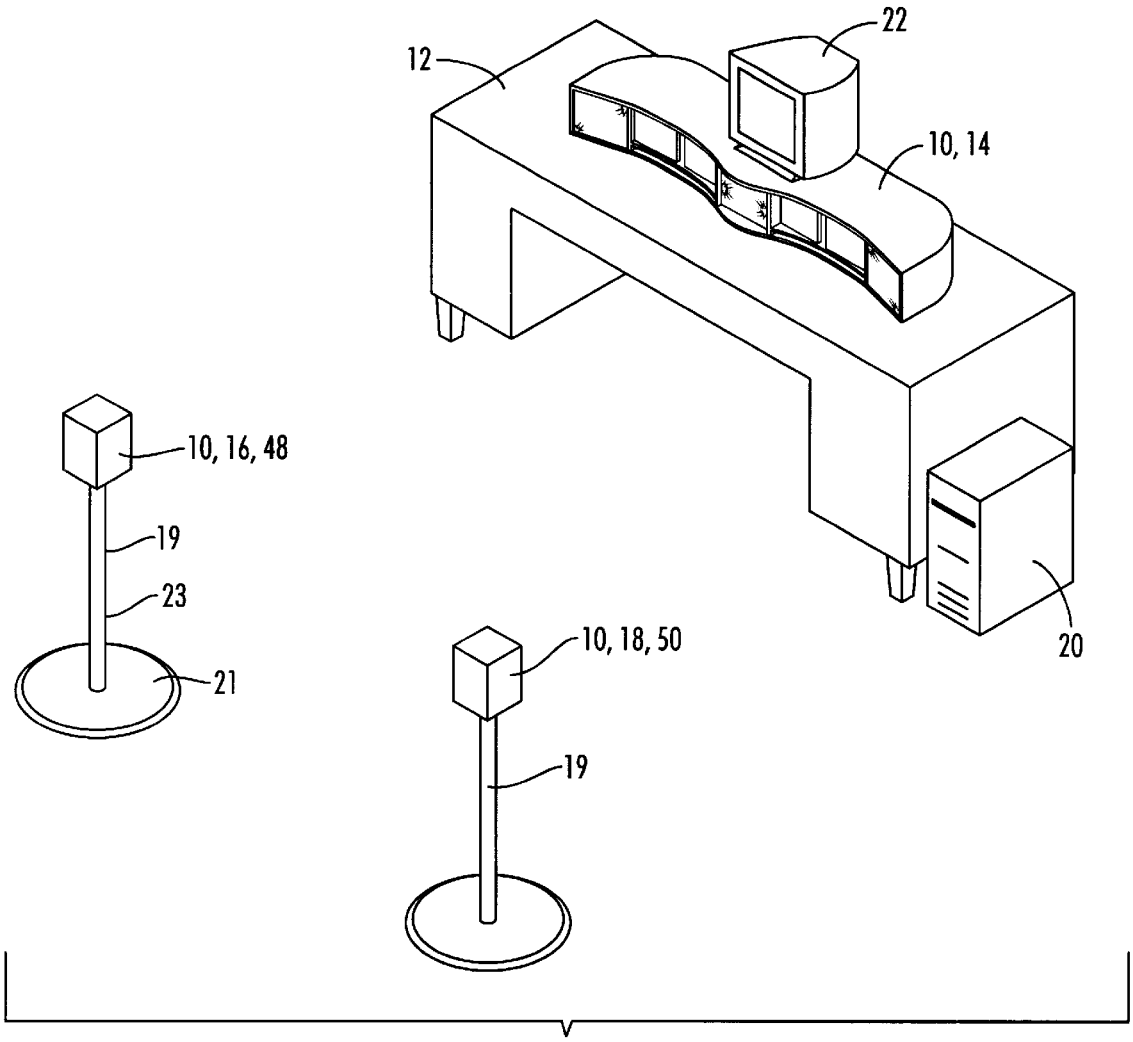
FIG. 1 is a perspective view of the speaker system of the present invention assembled with a personal computer and monitor on a conventional desk with the remote speakers being shown located in front of the desk on conventional microphone stands.

Referring now to the drawings, and particularly to FIG. 1, the speaker system of the present invention is shown and generally designated by the numeral 10. The speaker system 10 is shown in place upon a desktop 12. The speaker system 10 includes a main cabinet 14 and includes left and right remote speaker cabinets 16 and 18.

The remote cabinets 16 and 18 will be 195 mm cubes, with the front and back walls constructed from 25 mm thick medium density fiberboard (MDF), and with the sides constructed of 15 mm thick MDF. These units have infinite baffles, removable foam grills and mic stand mounting plates. The mounting plates are fitted internally so they do not protrude through the bottom of the cabinets. This allows the cabinets to be shelf mounted if necessary.

A personal computer 20 is shown adjacent the desk. A computer monitor 22 is shown in place upon the cabinet 14.

Figure 2:
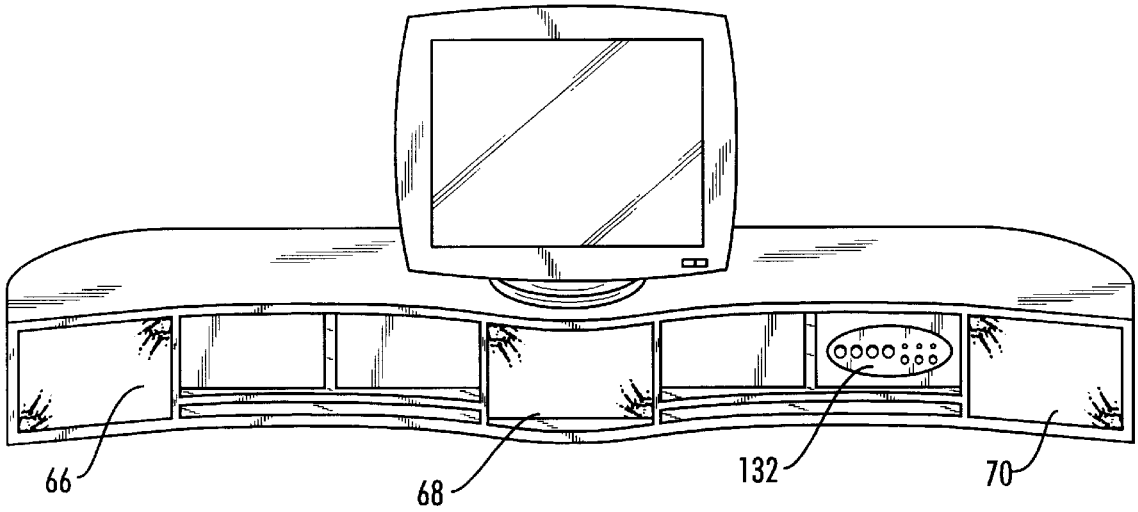
FIG. 2 is an enlarged perspective view of the cabinet of the speaker system with a computer monitor sitting on top of the cabinet.
Figure 4:
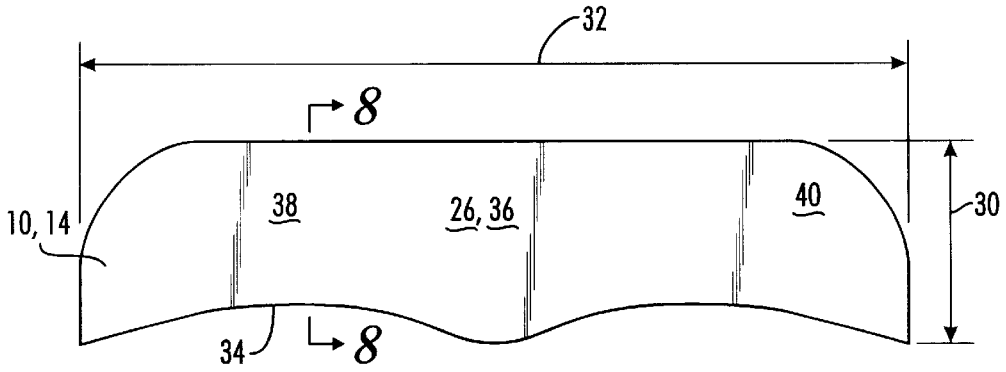
FIG. 4 is a plan view of the cabinet of the system of FIG. 2.
Figure 5:
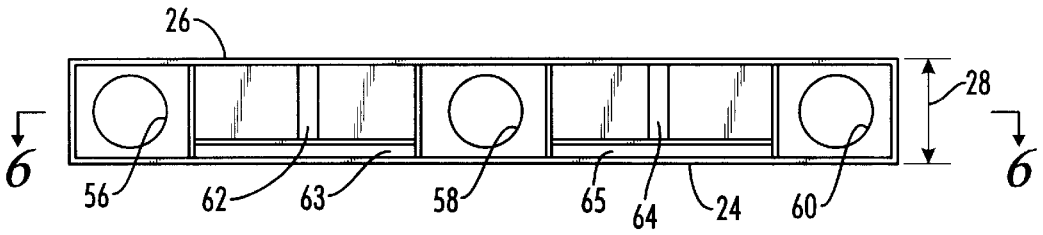
FIG. 5 is a front elevation view of the cabinet of FIG. 4.

The cabinet 14 is best seen in FIGS. 2, 4 and 5. The cabinet 14 has a bottom surface 24 for placement upon the desktop 12, and has a top surface 26 for supporting the computer monitor 22. The cabinet has a height 28, a depth 30, and a width 32 as shown in FIGS. 4 and 5. In one preferred embodiment, the height 28 is approximately 7 ⅝" (195 mm), the depth 30 is approximately 12" (300 mm) and the width 32 is approximately 48" (1,225 mm).

In general, the relative dimensions of the cabinet are such as to create a cabinet which is shallow in height and which expands its width across most of the width of a conventional desktop 12, and has a depth which occupies a rear portion of the desktop 12 while still allowing substantial unobstructed workspace on the desktop 12 in front of the cabinet 10. In general, the representative dimensions set forth above can be described as a cabinet having a width 32, a depth 30 and a height 28, the depth 30 being greater than the height 28, and the width 32 being at least four times as great as the height 28. The height of the cabinet can be described as being at least 7". The width 32 may also be described as being at least three times as great as the depth 30.

As seen in the plan view of FIG. 4, the cabinet 14 includes a front wall 34 which is irregular in plan view so that the depth 30 of the cabinet varies along the width 32 of the cabinet. The front wall 34 is profiled to look similar to a car dashboard with the left and right speakers 42 and 46 angled in at approximately 15°.

The cabinet 14 can be described as including a central portion 36 and left and right end portions 38 and 40, with the central portion 36 including the top surface 26 for supporting the computer monitor.

The cabinet 14 is preferably constructed from medium density fiberboard (MDF) which is an acoustically superior material for construction of speaker cabinets.

Figure 6:
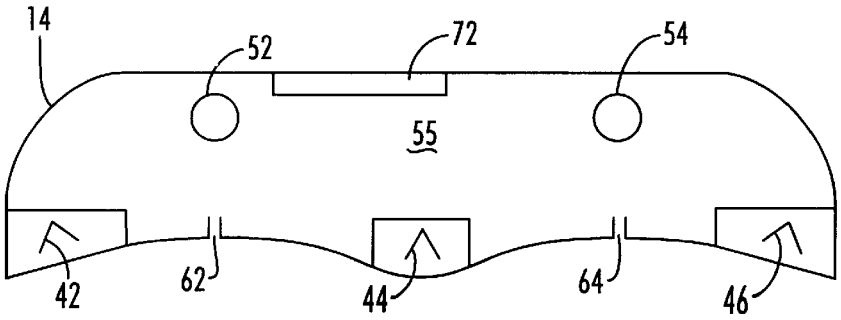
FIG. 6 is a plan cross-section view taken along line 6—6 of FIG. 5 showing the internal construction of the cabinet including location of the electronics board and location of the various baffling and the like associated with the speakers contained in the cabinet.

As is schematically illustrated in FIG. 6, the cabinet 14 includes first, second and third speakers 42, 44 and 46 housed in the cabinet. Speakers 42, 44 and 46 function as the left front, center front and right front speakers, respectively, when utilized with a Dolby® 5.1 format audio source.

The system 10 also includes fourth and fifth speakers 48 and 50 housed in the remote cabinets 16 and 18 which function as the left rear and right rear speakers, respectively, when utilized with a Dolby® 5.1 format audio source.

The system 10 further includes two sub-woofer speakers 52 and 54 located within a chamber 55 in the cabinet 14.

The front wall 34 of cabinet 14 will include first, second and third speaker openings 56, 58 and 60 within which the speakers 42, 44 and 46, respectively, are received. As seen in FIG. 2, the speaker openings 56, 58 and 60 are covered with suitable grills 66, 68 and 70, respectively.

Figure 8:
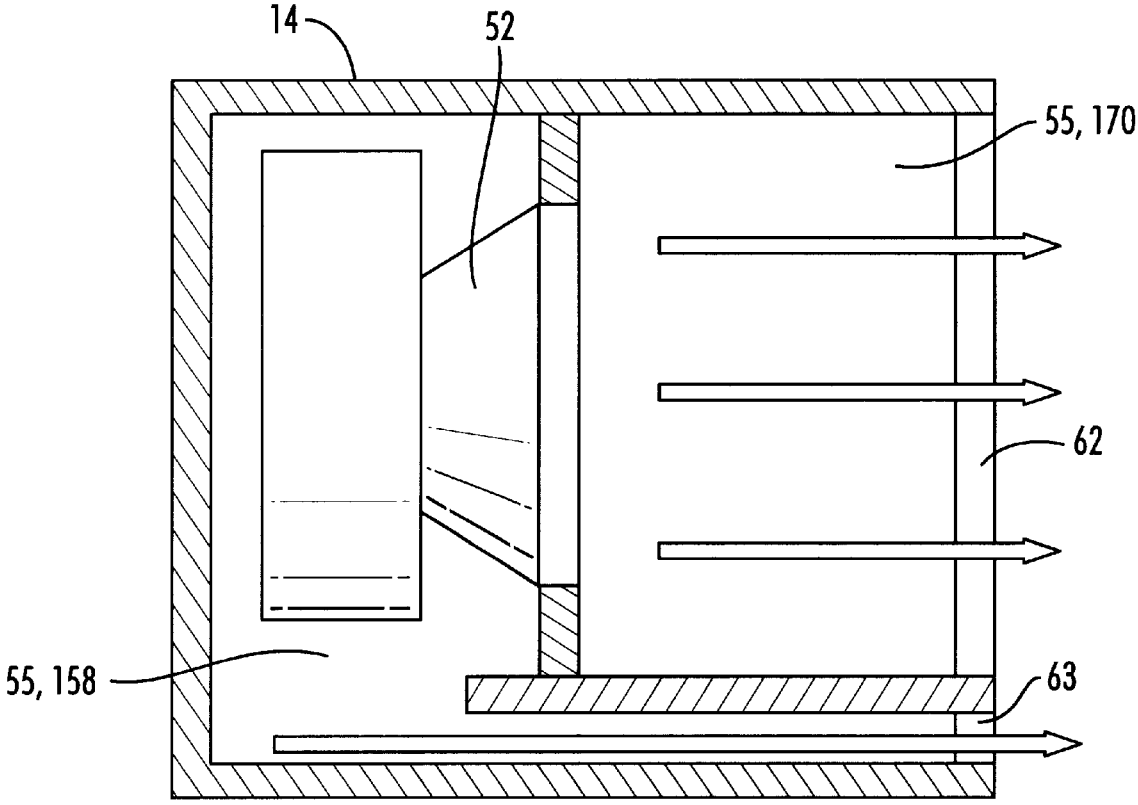
FIG. 8 is a schematic cross-section view taken along line 8—8 of FIG. 4, showing the manner in which the sub-bass speakers are mounted in the cabinet and showing the porting of the cabinet.
Figure 9:
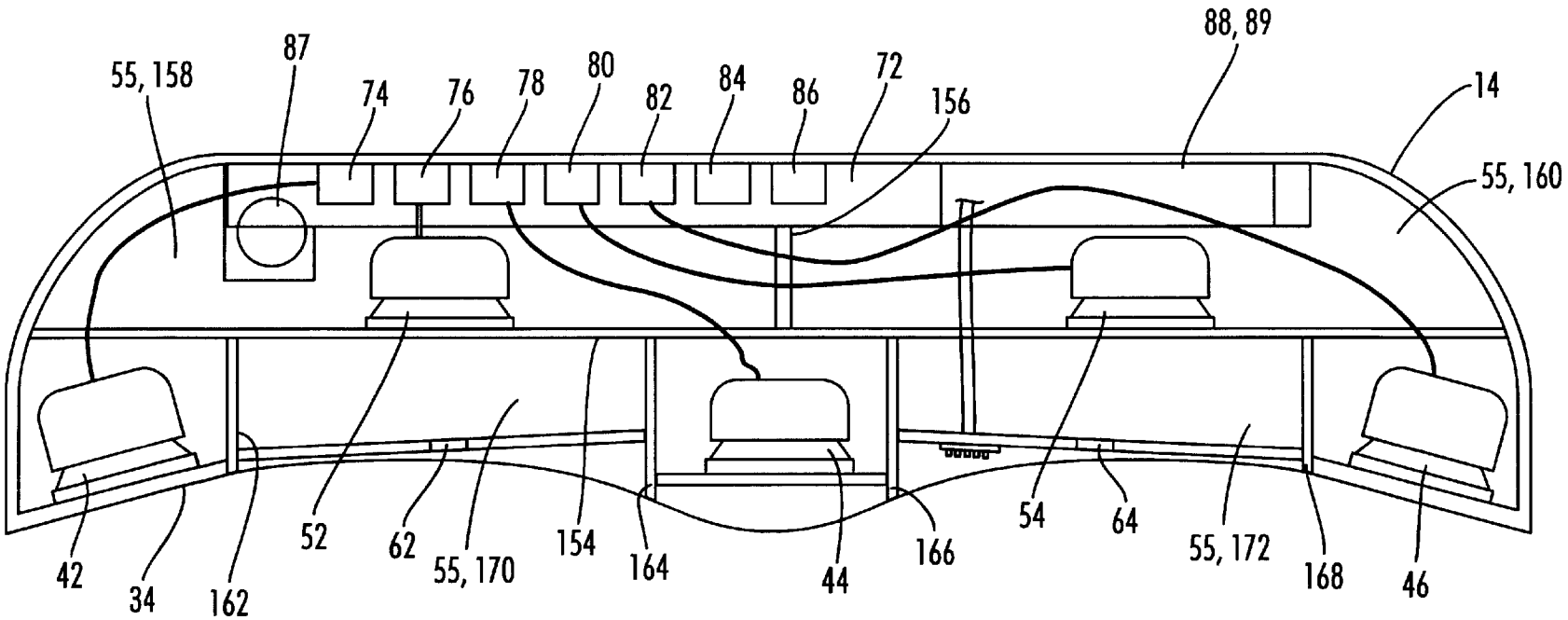
FIG. 9 is an enlarged view of FIG. 6 showing internal baffling and speaker mounting within the cabinet.

Preferably, all seven speakers 42–54 utilize the same type of speaker elements to achieve a fully balanced system. The left and right front speakers 42 and 46 are each full range direct radiating speakers. The center front speaker 44 is a high pass filtered speaker. The sub-bass speakers 52 and 54 are mono-band pass sub-bass drivers. All of the loudspeakers will be fully magnetically shielded for CRT proximity and all units except the sub-base speakers 52 and 54 will have center mounted, filtered, high frequency devices for space saving and phase-coherent point source sound. Each of the five direct radiating speakers 42, 44, 46, 48 and 50 will be covered with removable, 20 mm thick, acoustically transparent foam, fitted to the baffles with long Velcro® discs. FIG. 8 and FIG. 9 show the manner in which the interior of the cabinet 14 is divided by various baffles into chambers, and it also shows the manner in which the speakers are mounted and shows the location of the various electronics.

The cabinet 14 has an interior chamber generally designated by the numeral 55. The chamber 55 is divided into a series of sub-chambers associated with the various speakers.

A longitudinal baffle 154 extends across the width of the cabinet 14. A cross-baffle 156 separates the rearward portion of chamber 55 into first and second rear chambers 158 and 160.

First, second, third and fourth forward cross-baffles 162, 164, 166, and 168 isolate the front speakers 42, 44, and 46 and define first and second front chamber portions 170 and 172, respectively.

The first sub-woofer 52 is mounted on the longitudinal baffle 154 adjacent the center of first front chamber portion 170 so that the first speaker 52 radiates both forward into first front chamber 170 and rearward into first rear chamber 158. Similarly, the second sub-woofer 54 is mounted on the longitudinal baffle 154 adjacent second forward chamber portion 172 so that the second sub-woofer 54 radiates forward into second forward chamber portion 172 and rearward into second rear chamber portion 160.

Then, as best seen in FIG. 8, the front chamber portion 170 is communicated with the exterior of cabinet 14 through a first vertical slotted port 62, and the first rear chamber portion 158 is communicated with the exterior of cabinet 14 through a first horizontal slotted port 63. The slotted ports 62 and 63 are further shown in the front view of FIG. 5.

The second sub-woofer 54 is communicated with the exterior of cabinet 14 similarly by second vertical slot 64 and second horizontal slot of port 65 as seen in FIG. 5.

This type of mounting of the sub-bass speakers is referred to as a dual vented bandpass enclosure. Bandpass refers to a band of frequencies that this speaker configuration will reproduce, frequencies either side of this will be rejected. This type of arrangement has the advantage that it has its own natural crossover frequency and will attenuate higher frequencies at roughly 12 dB per octave. As applied to the present invention, this arrangement is particularly efficient because higher frequency signals are electronically filtered before they reach the sub-bass speakers 52 and 54, and thus the resonance problems at the ported vents which are sometimes associated with such construction at higher audible frequencies is not a problem.

The principle behind the dual vented bandpass enclosure is as follows. A partition is placed somewhere is near the center of the enclosure and the bass speaker is mounted on this. The longitudinal baffle 154 is such a partition. This longitudinal baffle 154 serves as the speaker baffle. The front chamber 170 is then vented or slot ported to tune the cabinet. In this way, the audio output is from the vent 62 and no direct output comes from the speaker driver 52 itself. The horizontal vent 63 in turn, vents the first rear chamber portion 158. The audio output therefore comes from this second horizontal vent 63, as well as the vertical vent 62. This extends the low bass response of the combined enclosure of first sub-woofer 52 down below those frequencies at which a conventional "direct radiating" bass cabinet would produce, because the present arrangement allows for maximum controlled excursion of the speaker. If the rear speaker chamber 158 were sealed, then the sub-bass speaker 52 is held much tighter because of the enclosed air contained in rear chamber 158 and the bass response of the speaker 52 would roll off at a higher frequency. The arrangement illustrated results in an extended bass response, as compared to a "direct radiating" bass arrangement which would normally require a larger speaker cone area to achieve a comparable response.

The irregular plan shape of front wall 34 as seen in FIG. 4 results in the first, second and third speakers 42, 44 and 46 being directed non-parallel to each other. In the specific embodiment illustrated, the center speaker 44 faces directly forward. The left and right front speakers 42 and 46 are aimed about 15° toward the center and forward.

The slotted port acoustical outlets 62 and 63 associated with first sub-woofer 52 may be described as first sub-woofer openings 62 and 63 defined in the front wall 34 between the first and second speaker openings 56 and 58. Similarly, the slotted port acoustic outlets 64 and 65 associated with second sub-woofer 54 may be described as a sub-woofer openings 64 and 65 defined in the front wall 34 between the second and third speaker openings 58 and 60.

The system 10 also includes self adhesive feet (not shown) for all units, the two microphone stands 19, and lengths of suitable speaker cable to connect the remote speakers 48 and 50 to the amplifier 72. The wiring connecting amplifier 72 to the rear speakers 48 and 50 may be flat tape adhesive wiring. One advantage of the system 10 is that all of the wiring between the amplifiers and speakers is contained within the cabinet 14 which eliminates the typical wiring "nest" associated with multiple speaker systems utilized with personal computers.

Figure 7:
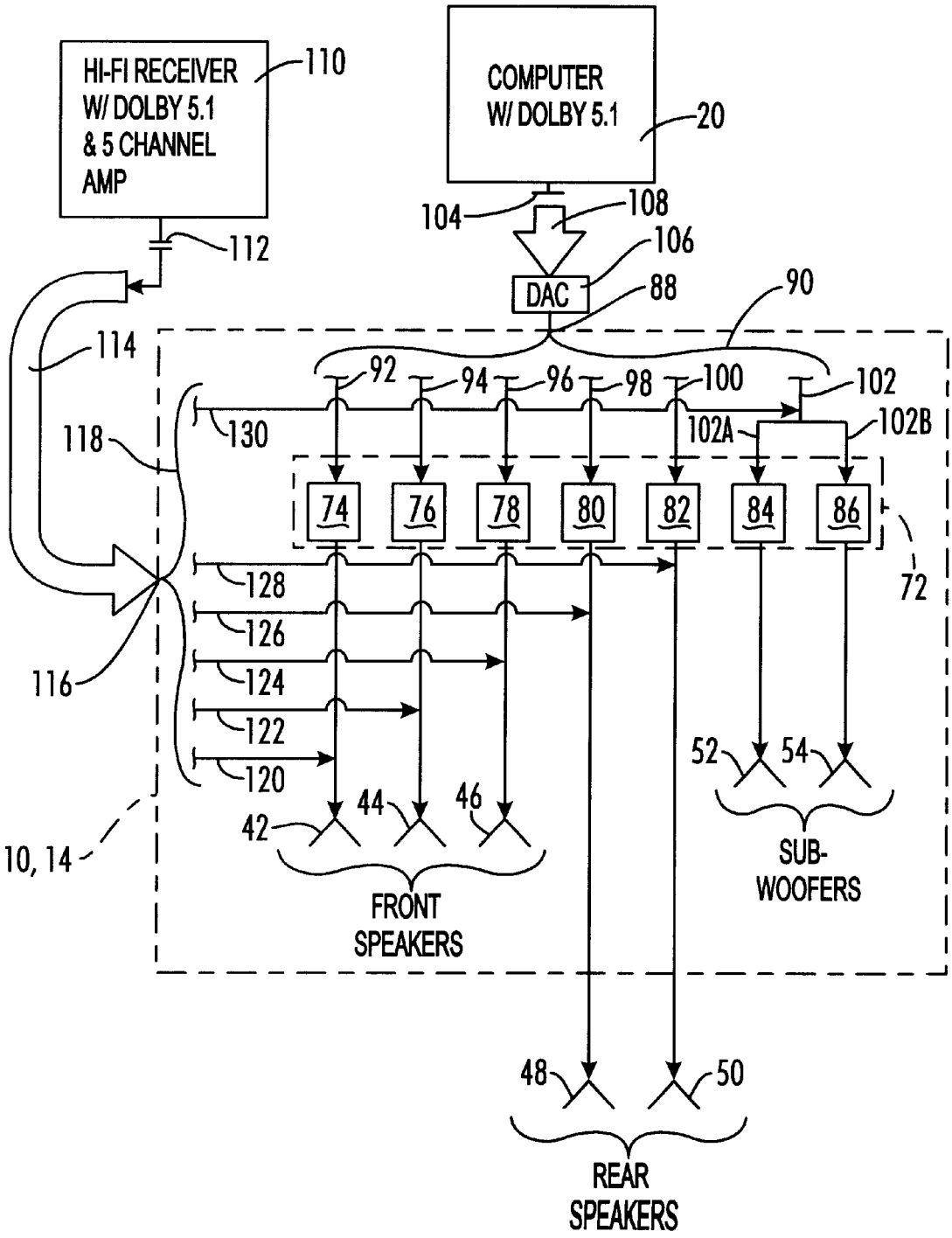
FIG. 7 is an electrical schematic illustration of the amplifier system contained in the cabinet of FIG. 2 and its connections to a Dolby® 5.1 signal from the computer or alternatively from a hi fidelity receiver.

Referring now to FIG. 7, a schematic illustration is there shown of the amplifier system included in the speaker system 10 and the various connections to the speakers 42–54.

The amplifier 72 preferably includes first through seventh channels of amplification designated as 74, 76, 78, 80, 82, 84 and 86. The preferred location of the amplifier components in best shown in FIG. 9. A main transformer 87 provides electrical power to the amplifiers.

As is apparent in FIG. 7, the first through seventh channels of amplification 74–86 are associated with the first through seventh speakers 42–54, respectively.

The amplification channels 74–86 will each provide approximately 35–40 watts of power, and increased power may be provided to the sub-bass speakers 52 and 54 if necessary.

The amplifier components 74–86 may, for example, be model ILP HY2001 Power Amplifiers available from ILP Direct Ltd. of Sponge Lane, Elmsted, Ashford, Kent UK TN 25 5JU. This amplifier is passively cooled with an aluminum heat sink (not shown).

The cabinet 14 has a primary signal inlet port 88 by means of which a signal source such as the computer 20 is connected to a primary inlet signal conductor 90 which carries six channels of audio data 92, 94, 96, 98, 100 and 102. The first through fifth channels 92–100 are associated with the first through fifth amplifier channels 74–82, respectively, as shown in FIG. 7.

The sixth channel of audio data 102 carries the low frequency data from the Dolby® 5.1 format. This sixth channel 102 is split into two identical signals 102A and 102B which are carried to the sixth and seventh amplifier channels 84 and 86 associated with the two sub-woofer units 52 and 54. The sixth low frequency data channel 102 contains additional bass information to maximize the effect of events such as explosions, crashes, etc. In the Dolby® 5.1 format, this sixth channel has a limited frequency response from 3 Hz to 120 Hz, and it is sometimes referred to as the "0.1" channel of the Dolby® 5.1 system.

The primary signal input port 88 is located on a circuit board 89 shown in FIG. 9, which carries the various inputs and outputs for cabinet 14.

The primary input signal received at the primary signal input port 88 comprises six channels of analog audio data. This primary input signal can be created in several ways.

One such source is the use of a modern personal computer 20, many of which now include DVD players which play DVD's which have a Dolby® 5.1 formatted soundtrack. The computer 20 when so equipped, will typically have a sound card that has an outlet port which is either a single co-axial RCA type connector or a fiber-optic output connector, either of which can carry multiple channels of digital audio data in a SP/DIF format.

In FIG. 7, the output port from the sound card of computer 20 is schematically illustrated as 104. The computer 20 is equipped internally with suitable electronics for decoding the compressed Dolby® 5.1 signal to create six channels of expanded, but still digital audio data.

At some point between the audio signal output port 104 of computer 20 and the primary signal input port 88 of the system 10, there must be a digital to analog converter 106. The output port 104 of computer 20 will be connected to digital to analog converter 106 by suitable co-axial cables, optical fiber or the like which is designated by the numeral 108.

The digital to analog converter 106 may either be a separate stand alone component which is connected to the inlet port 88 of cabinet 14, or it may optionally be located within the cabinet 14 itself. The digital to analog converter 106 may, for example, be an "Audio Storm Digital Decoder Box" available from Minton Optic Industry Co., Ltd. of Chung Ho City, Taipei, Taiwan. This particular digital to analog converter 106 provides the capability of handling all commonly available audio sources including the Dolby® digital 5.1 format and many others. Other formats which are in common use and can be handled by the digital audio converter 106 include the Dolby® Surround Pro Logic system which provides four channels of analog data. Digital to analog converter 106 may also be utilized with conventional two channel analog stereo inputs carried by two RCA connectors. The digital to analog converter 106 may also be utilized or adapted to accept other multi-channel digital formats similar to the Dolby® 5.1 system, such, for example, the DTS system.

It will be appreciated that once a computer user has the system 10 associated with his personal computer 20, he may desire to utilize other sound sources with the speaker system 10.

Such an alternative sound source may be found in a conventional high fidelity receiver 110. Modern day high fidelity receivers typically include Dolby® 5.1 capability, and they include five channels of amplification resulting in six channels of analog audio data available at an output port 112 of the receiver 110. Five of those channels of audio data are amplified, and are ready to be directed to a mechanical speaker, and the sixth channel of low frequency data is unamplified. The sixth channel is unamplified because typical sub-woofer speaker systems as they are presently available are active systems which include their own amplification.

Thus, to utilize the Hi-Fi receiver 110 as a sound source, its outlet 112 will be connected to a by-pass input port 116 of the cabinet 14 by a suitable cable 114.

It will be appreciated that the outlet 112 and the inlet port 116 may, in fact, be comprised of six individual stereo jack connections and the cable 114 may be comprised of six individual cables.

The six channels of analog audio data carried over cable 114 to by-pass inlet port 116 are then carried by a by-pass inlet conductor 118. The first five channels 120, 122, 124, 126 and 128 by-pass the first five stages of amplification of amplifier 72 and go directly to the speakers 42, 44, 46, 48 and 50, respectively. There is no need for further amplification of those signals because they have been amplified in the Hi-Fi receiver 110. The unamplified sixth channel 130 of low frequency audio data is carried to the sixth and seventh amplification channels 84 and 86 of amplifier 72 where they may be amplified prior to being carried to the two sub-woofers 52 and 54.

Thus, the by-pass inlet port 116 and by-pass conductor 118 function to by-pass the first five channels of analog audio data directly to the first five speakers, while carrying the sixth channel of low frequency data to the amplifiers associated with the sub-woofers of the system 10.

Figure 3:
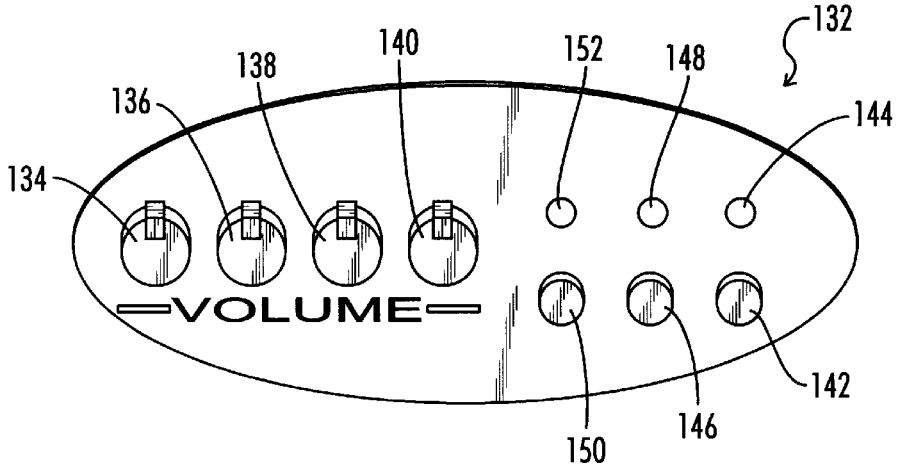
FIG. 3 is an enlarged front view of the control panel of the speaker system of FIG. 2.

The front wall 34 carries a control panel 132 which is shown in detail in FIG. 3. Control panel 132 includes four separate volume controls. The first volume control 134 controls the left and right front speakers 42 and 46. The second volume control 136 controls left and right rear speakers 48 and 50. The third volume control 138 controls center front speaker 44. The fourth volume control 140 controls the two sub-woofers 52 and 54.

Control panel 132 also includes a power on/off button 142 with associated indicator light 144. There is also a test button 146 with associated indicator light 148. Finally, there is a Dolby® on/off 150 with associated indicator light 152.

Thus, it is seen that the apparatus of the present invention readily achieves the ends and advantages mentioned as well as those inherent therein. While certain preferred embodiments of the invention have been illustrated and described for purposes of the present disclosure, numerous changes in the arrangement and construction of parts may be made by those skilled in the art, which changes are encompassed within the scope and spirit of the present invention as defined by the appended claims.

What is claimed is:

1. A multi-channel audio speaker system for use with a desktop personal computer, comprising:

a cabinet having a bottom surface for placement upon a desktop and having a top surface for supporting a computer monitor;

first, second and third speaker housed in the cabinet;

fourth and fifth speakers located remote from the cabinet;

an amplifier housed in the cabinet and including at least first, second, third, fourth and fifth channels of amplification connected to said first, second, third, fourth and fifth speakers, respectively;

a primary inlet signal conductor for carrying at least five channels of audio data to the amplifier; and wherein the cabinet includes a front side having first, second and third speaker openings defined therein;

wherein the first, second and third speakers are received in the first, second and third speaker openings; and wherein the front side is irregular shaped so that said first, second and third speakers are directed non-parallel to each other with the first and third speakers being located on opposite sides of the second speaker, and the first and third speakers facing forward and at an angle toward each other.

2. The system of claim 1, further comprising:

a sub-woofer speaker contained in the cabinet; and the amplifier including a sixth channel of amplification connected to the sub-woofer speaker.

3. The system of claim 1, further comprising:

two sub-woofer speakers contained in the cabinet;

the amplifier including sixth and seventh channels of amplification, each one of which is connected to one of the two sub-woofer speakers; and the primary inlet signal conductor carrying a sixth channel of low frequency audio data, the sixth channel of low frequency data being split and being connected to each of the sixth and seventh amplifier channels.

4. The system of claim 3, further comprising:

the cabinet including baffling defining a front and a rear chamber portion associated with each sub-woofer speaker, and the cabinet including ports communicating each chamber portion with the exterior of the cabinet.

5. The system of claim 1, further comprising:

a bypass inlet signal conductor for bypassing the amplifier and carrying the five channels of audio data to the first through fifth speakers.

6. The system of claim 5, further comprising:

a sub-woofer speaker contained in the cabinet; and the amplifier including a sixth channel of amplification connected to the sub-woofer speaker.

7. The system of claim 5, further comprising:

two sub-woofer speakers contained in the cabinet;

the amplifier including sixth and seventh channels of amplification, each one of which drives one of the two sub-woofer speakers; and the bypass inlet signal conductor carrying a sixth channel of low frequency audio data, the sixth channel of low frequency data being split and being connected to each of the sixth and seventh amplifier channels.

8. The system of claim 1, further comprising:

first and second sub-woofers contained in the cabinet;

the cabinet comprising a first sub-woofer opening defined in the front wall between the first and second speaker openings, and a second sub-woofer opening defined in the front wall between the second and third speaker openings; and the first and second sub-woofers being communicated with the first and second sub-woofer openings, respectively.

9. The system of claim 1, in combination with a Dolby 5.1 audio signal source, the first, second and third speakers being left, center and right front speakers and the fourth and fifth speakers being left and right rear speakers.

10. The system of claim 9, wherein the Dolby 5.1 audio signal source is contained in the personal computer.

11. The system of claim 9, wherein the Dolby 5.1 audio signal source is contained in a Hi-Fi receiver separate from the personal computer.

12. The system of claim 1, wherein:

the fourth and fifth speakers are supported on two microphone stands.

13. The system of claim 1, wherein:

the cabinet has a width, a depth and a height, the depth being greater than the height, and the width being at least four times as great as the height.

14. The system of claim 13, wherein:

the cabinet includes a central portion and left and right end portions, the central portion including the top surface for supporting the computer monitor.

15. The system of claim 13, wherein:

the height of the cabinet is at least seven inches.

16. A desktop speaker system for use with a personal computer, comprising:

a cabinet having a width, a depth and a height, the depth being greater than the height, and the width being greater than the depth;

at least three speakers housed in the cabinet;

first and second sub-woofers contained in the cabinet;

an amplifier including at least five channels of amplification, three of which are connected to the three speakers;

a primary inlet signal conductor for carrying at least five channels of audio data to the amplifier;

wherein the cabinet includes a front side having first, second and third speaker openings defined therein, a first sub-woofer opening defined in the front side wall between the first and second speaker openings, and a second sub-woofer opening defined in the front side between the second and third speaker openings;

wherein the three speakers are received one in each of the first, second and third speaker openings; and the first and second sub-woofers being communicated with the first and second sub-woofer openings, respectively.

17. The system of claim 16, wherein:

the cabinet includes a front wall which is irregular in plan view so that the depth of the cabinet varies along the width of the cabinet.

18. The system of claim 17, wherein:

the cabinet includes a central portion and left and right end portions, the central portion including a top surface for supporting the computer monitor.

19. The system of claim 16, wherein:

the height of the cabinet is at least seven inches.

20. The system of claim 16, wherein:

the width of the cabinet is at least three times the depth of the cabinet.

21. The system of claim 19, further comprising:

two separate remote speakers connected to two of the channels of amplification other than the channels connected to the three speakers in the cabinet.

22. The system of claim 21, further comprising:

a bypass inlet signal conductor for bypassing the amplifier and carrying the five channels of audio data to the speakers.

23. The system of claim 16, further comprising:

two sub-woofer speakers contained in the cabinet;

the amplifier including sixth and seventh channels of amplification, each one of which is connected to one of the two sub-woofer speakers; and the primary inlet signal conductor carrying a sixth channel of low frequency audio data, the sixth channel of low frequency data being split and being connected to each of the sixth and seventh amplifier channels.

24. The system of claim 16, wherein:

the front side is irregular shaped so that the three speakers are directed non-parallel to each other.

25. A speaker and monitor assembly, comprising:

a desktop;

a cabinet sitting on the desktop and including a cabinet top surface;

at least three speakers contained in the cabinet;

an amplifier contained in the cabinet, and including at least three channels of amplification, each one of which is connected to one of the three speakers;

a computer monitor sitting on the cabinet top surface;

a computer including a multi-channel audio source connected to the amplifier; and wherein the cabinet includes a front wall which is irregular in plan view so that the depth of the cabinet varies along the width of the cabinet, and the cabinet has a front side which is irregular shaped so that two outermost ones of the three speakers are located toward opposite ends of the cabinet and are facing forward and at an angle toward each other.

26. The assembly of claim 25, wherein:

the multi-channel audio source of the computer comprises a Dolby 5.1 source.

27. The assembly of claim 25, further comprising:

a sub-woofer contained in the cabinet;

two remote speakers separate from the cabinet; and wherein the amplifier includes three additional channels of amplification connected to the sub-woofer and the two remote speakers.

28. An amplified speaker system, comprising:

first, second, third, fourth and fifth surround speakers;

a sixth sub-woofer speaker;

an amplifier including first, second, third, fourth, fifth and sixth channels of amplification connected to the first, second, third, fourth, fifth and sixth speakers respectively;

a primary inlet signal conductor for carrying at least six channels of audio data to the amplifier; and a bypass inlet signal conductor for bypassing the first through fifth channels of the amplifier and carrying five channels of audio data to the first through fifth speakers, respectively, while still carrying the sixth channel of audio data for the sub-woofer speaker to the sixth channel of amplification of the amplifier.

* * * * *

UNITED STATES PATENT AND TRADEMARK OFFICE

CERTIFICATE OF CORRECTION

PATENT NO. : 6,381,335 B2
DATED : April 30, 2002
INVENTOR(S) : Juszkiewicz

It is certified that error appears in the above-identified patent and that said Letters Patent is hereby corrected as shown below:

Column 8,
Line 32, replace “speaker” with -- speakers --.

Column 10,
Line 6, delete “wall” after -- side --.

Signed and Sealed this

Fourteenth Day of January, 2003

JAMES E. ROGAN
*Director of the United States Patent and Trademark Office*